US005371918A

United States Patent [19]

Shero

[11] Patent Number: 5,371,918

[45] Date of Patent: Dec. 13, 1994

[54] WATER HEATER FOR CARPET CLEANING SYSTEMS

[76] Inventor: William K. Shero, 17287 Mt. Hermann, Unit A, Fountain Valley, Calif. 92708

[21] Appl. No.: 58,980

[22] Filed: May 5, 1993

[51] Int. Cl.[5] ..... A47L 7/00

[52] U.S. Cl. ..... 15/321; 122/7 R; 122/17

[58] Field of Search ..... 122/17, 32, 7 R; 15/321

[56] References Cited

U.S. PATENT DOCUMENTS

| | | | |
|---|---|---|---|
| 4,940,082 | 7/1990 | Roden | 15/321 |
| 4,949,424 | 8/1990 | Shero | 15/321 |
| 4,991,254 | 2/1991 | Roden | 15/321 |
| 5,228,413 | 7/1993 | Tam | 122/17 |

*Primary Examiner*—Edward G. Favors
*Attorney, Agent, or Firm*—Stetina Brunda & Buyan

[57] ABSTRACT

A water heater for a carpet cleaning system has a first chamber and a main heat exchanger disposed within the first chamber, the main heat exchanger utilizing heat from a first source, preferably an engine, to heat water to be used in the carpet cleaning process. A second chamber substantially surrounds the first chamber and utilizes heat from a second source, preferably a blower in fluid communication with the carpet cleaning system's water tank. The second chamber substantially surrounds the first chamber to provide a thermal barrier between the first chamber and the ambient environment. The use of such a thermal barrier substantially reduces undesirable heat loss from the first chamber to the ambient environment and thus increases the efficiency of the water heater. A third chamber in fluid communication with the second chamber is heated by a second source and provides heat from the second source to the second chamber. A preheating heat exchanger disposed within the third chamber is in fluid communication with the main heat exchanger such that water flowing through the preheating heat exchanger is heated to a first temperature and then flows through the main heat exchanger where it is further heated to a second, higher, temperature.

15 Claims, 3 Drawing Sheets

WATER HEATER FOR CARPET CLEANING SYSTEMS

FIELD OF THE INVENTION

The present invention relates generally to carpet cleaning systems and more particularly to an improved water heater for carpet cleaning systems and the like.

BACKGROUND OF THE INVENTION

Carpet cleaning systems that utilize heated water or steam to clean carpets are well known in the art. Typically, these systems direct a source of water through a pump driven by an engine. The pump then directs the water through a safety valve and from there to a heat exchanger. Heated water exits the heat exchanger, passes through a thermostat, and is then directed to a hand held carpet cleaning wand.

The wand houses a trigger mechanism that controls the flow of fluid through the wand and onto the carpet. The wand further includes a vacuum suction inlet port which collects residual waste water and directs the waste water back to a waste water recovery tank maintained under a vacuum by an engine driven blower or vacuum pump.

The heat exchanger may utilize the hot exhaust gases of the engine which drives the water pump and blower. Thus, the exhaust gases are generally directed onto coiled tubing or the like through which the water to be heated flows. However, such systems suffer from the inherent deficiency that the heat exchange process between the hot exhaust gases and the water to be heated is generally inefficient. That is, heat transfer between the engine's exhaust gases and the water to be used in the carpet cleaning process requires a larger heat exchanger than is generally desired. As such, it is desirable to provide an improved heat exchanger which maximizes the efficiency of the heat transfer process such that the size of the heat exchanger may be reduced while maintaining heating of the water to a desired temperature.

Furthermore, the exhaust from both the engine and the blower contribute a significant amount of undesirable sound. Thus, it would also be desirable to provide a means for quieting the carpet cleaning device by reducing the amount of sound produced by the engine and blower.

SUMMARY OF THE INVENTION

The present invention specifically addresses and alleviates the above mentioned deficiencies associated in the prior art. More particularly, the present invention comprises a water heater for a carpet cleaning system which includes a first chamber and a main heat exchanger disposed within the first chamber. The main heat exchanger utilizes heat from a first source, preferably exhaust from an engine, to heat water to be used in the carpet cleaning process. A second chamber substantially surrounds the first chamber and is heated from a second source, preferably a blower in fluid communication with the carpet cleaning systems water tank. The second chamber substantially surrounds the first chamber to provide a thermal blanket or envelope about the first chamber and a thermal barrier between the first chamber and the ambient environment. The use of such a thermal envelope reduces undesirable heat loss from the first chamber to the ambient environment and thus increases the efficiency of the water heater.

A third chamber in fluid communication with the second chamber is heated by the second source and provides heat from the second source to the second chamber. A preheating heat exchanger is disposed within the third chamber and is in fluid communication with the main heat exchanger such that water flowing through the preheating heat exchanger is heated to a first temperature and then flows through the main heat exchanger where it is further heated to a second, higher, temperature.

The first, second, and third chambers are preferably disposed within a common housing such that the first and second chambers are isolated from the third chamber by a perforated baffle such that heated gas flows from the third chamber to the second chamber, but not from the third chamber to the first chamber. The common housing is preferably cylindrical in configuration with the first and second chambers disposed at a first end thereof and the third chamber disposed at a second end thereof.

The preheating heat exchanger preferably comprises coiled tubing, preferably copper, through which the water to be heated flows and also preferably comprises a heater core receiving the water from the coiled tubing.

A bypass communicates at least a portion of the water heated by the main heat exchanger back to the preheating heat exchanger, preferably via the water recovery tank.

The first chamber additionally serves as a muffler or silencer for the engine and the third chamber additionally serves as a muffler or silencer for the blower. The second chamber functions as an extension of the first and third chambers, thus further reducing the sound from the engine and blower, respectively. Furthermore, the second chamber also acoustically insulates the first chamber from the ambient environment and thereby reduces sound transfer thereto, thus further quieting the carpet cleaning system.

These, as well as other advantages of the present invention will be more apparent from the following description and drawings. It is understood that changes in the specific structure shown and described may be made within the scope of the claims without departing from the spirit of the invention.

DETAILED DESCRIPTION OF THE PREFERRED EMBODIMENT

The detailed description set forth below in connection with the appended drawings is intended as a description of the presently preferred embodiment of the invention, and is not intended to represent the only form in which the present invention may be constructed or utilized. The description sets forth the functions and sequence of steps for constructing and operating the invention in connection with the illustrated embodiment. It is to be understood, however, that the same or equivalent functions and sequences may be accomplished by different embodiments that are also intended to be encompassed within the spirit and scope of the invention.

Figure 1:
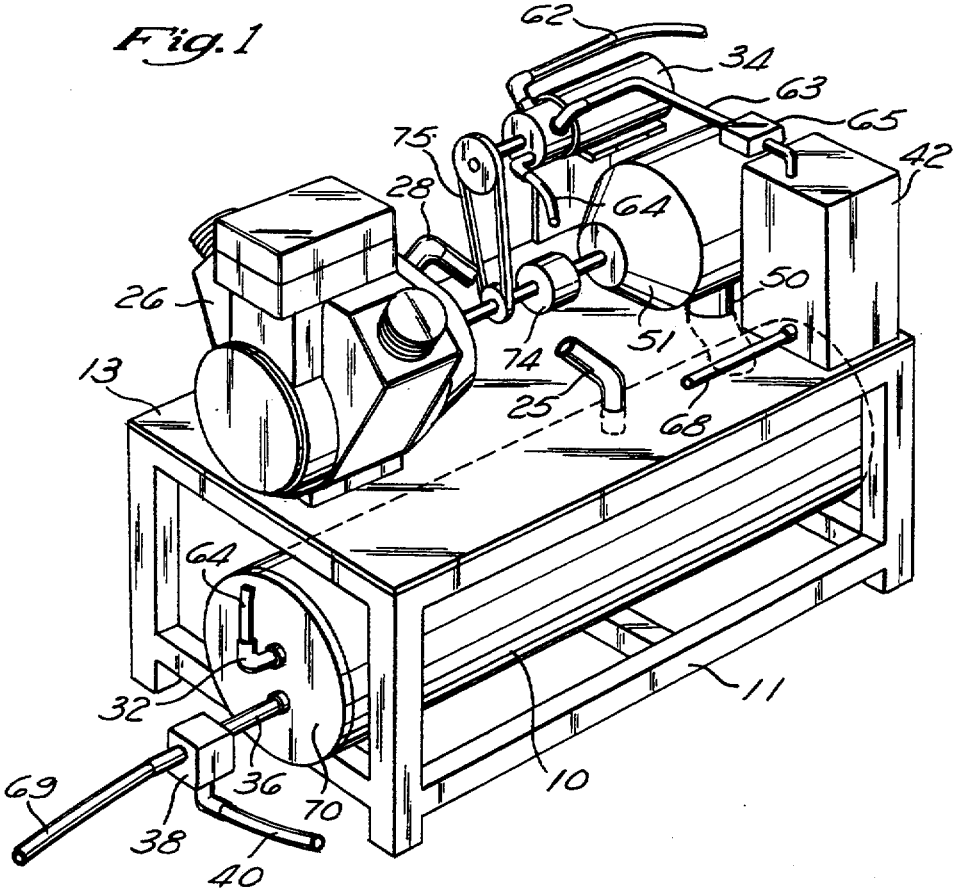
FIG. 1 is a perspective view of the water heater for carpet cleaning systems of the present invention.
Figure 2:
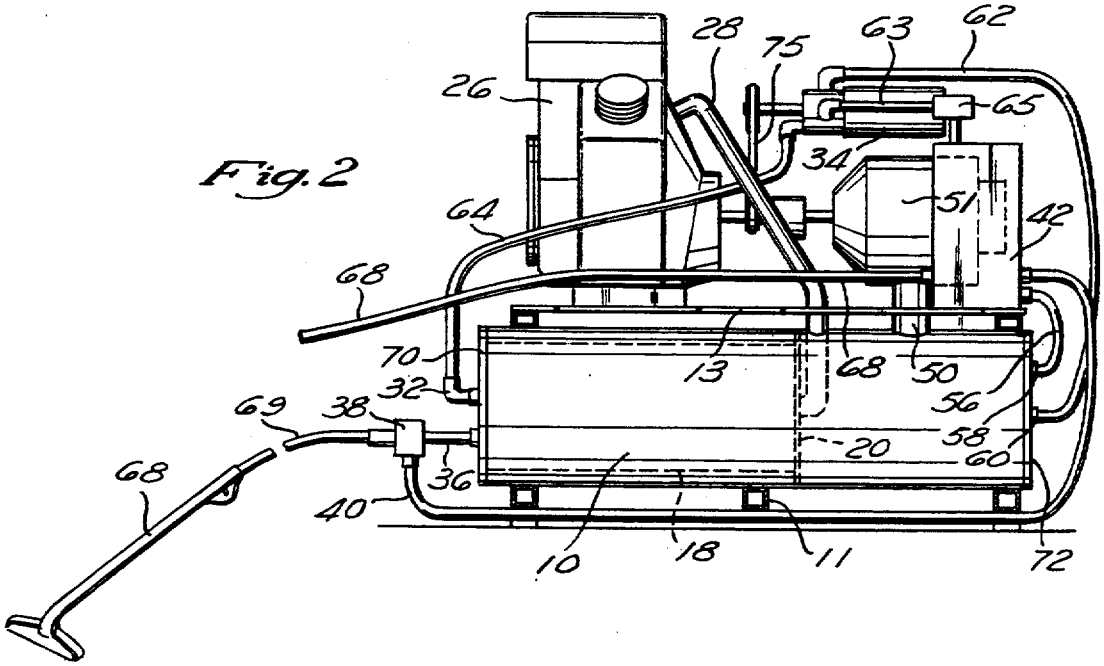
FIG. 2 is an elevational side view of the carpet cleaning system of FIG. 1.
Figures 3, 4, 5:
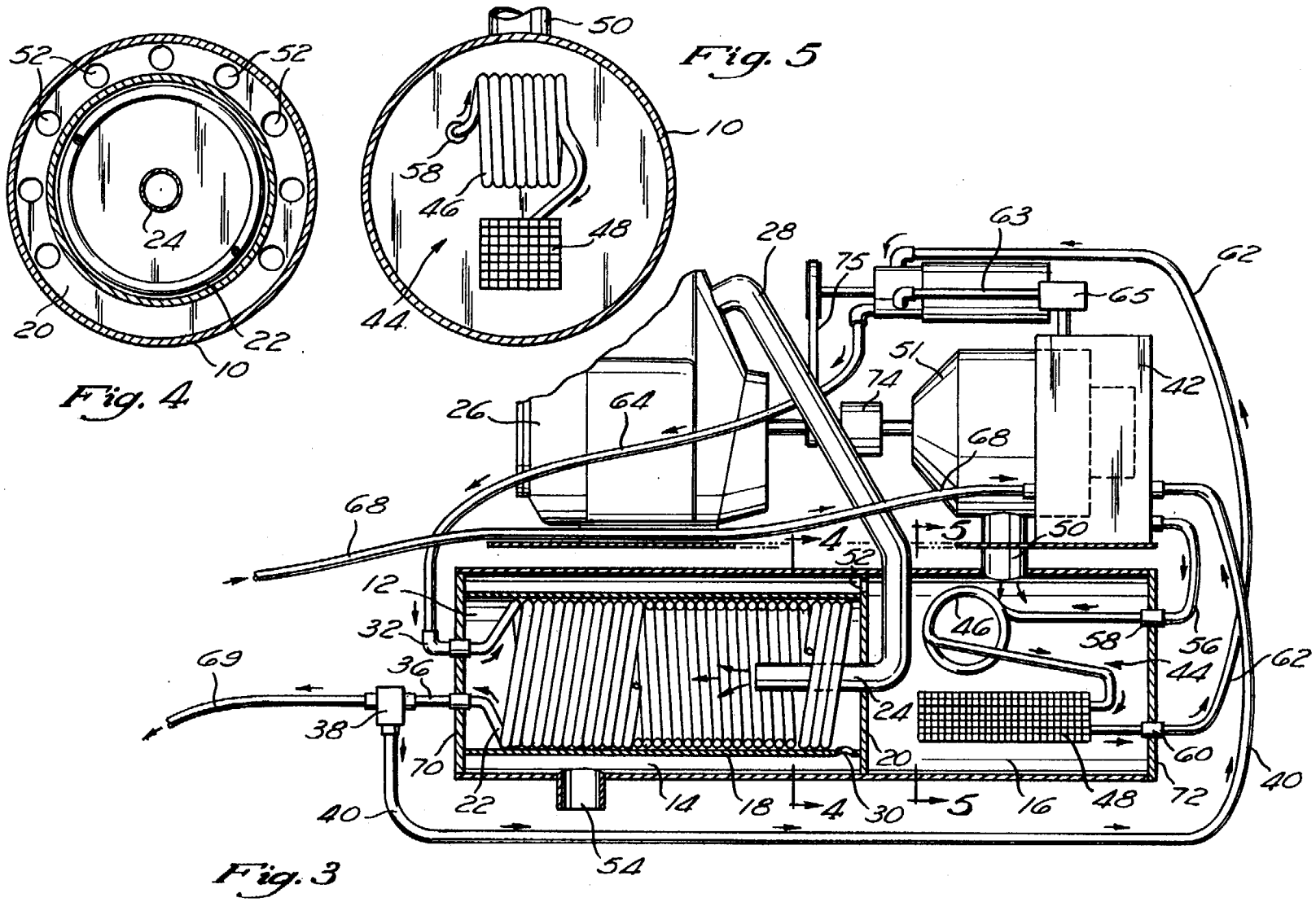
FIG. 3 is an enlarged elevational view of the carpet cleaning system of FIG. 2, partially in cross-section.
FIG. 4 is a cross-sectional end view of the first and second chambers taken along lines 4—4 of FIG. 3.
FIG. 5 is a cross-sectional view of the third chamber of the hot water heater taken along the lines 5—5 of FIG. 3.
Figure 6:
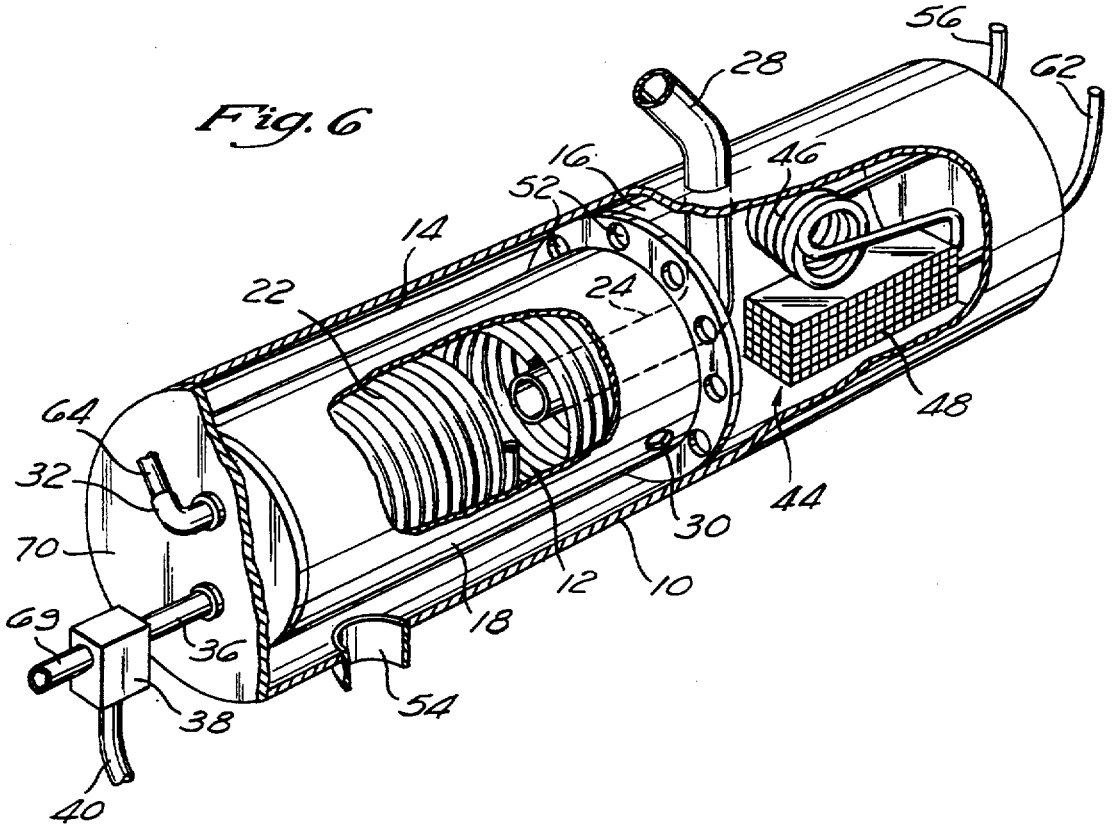
FIG. 6 is a perspective view of the cylindrical housing, partially in section, depicting the main and preheating heat exchangers of FIG. 3.
Figure 7:
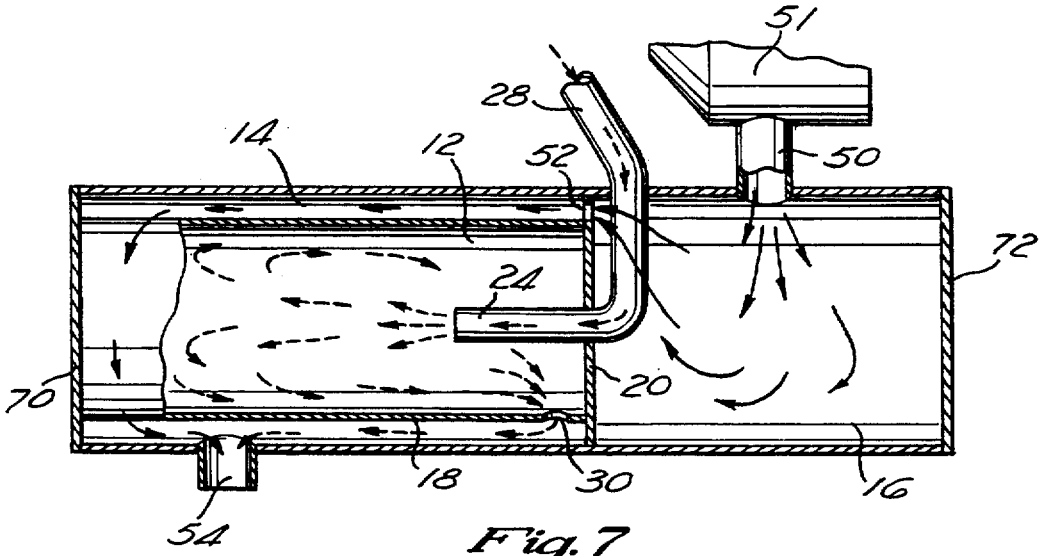
FIG. 7 is a cross-sectional side view of the cylindrical housing of FIG. 6 illustrating the engine and blower exhaust paths through the first, second, and third chambers, and having the primary and preheating heat exchangers removed therefrom for clarity.

The heater for carpet cleaning systems of the present invention is illustrated in FIGS. 1 through 7 which depict a presently preferred embodiment. Referring now to FIGS. 1–3, the water heater for carpet cleaning systems is generally comprised of a cylindrical housing 10, within which main heat exchanger 22 and preheating heat exchanger 44 are disposed, an engine 26, preferably an internal combustion engine, a pump 34 driven via belt 75 by engine 26, a blower 51 driven via coupling 74 by engine 26, and water recovery tank 42. The housing 10 is preferably circular in configuration. A support frame 11 provides mounting for the housing 10, motor 26, pump 34, blower 51, and water recovery tank 42. The housing 10 preferably is disposed within the frame 11 and the motor 26, pump 34, blower 51, and water recover tank 42 are preferably disposed upon a plate 13 which defines the upper surface of the frame 11.

Referring now to FIGS. 3–7, the housing 10 is segregated into a first chamber 12, a second chamber 14 substantially enveloping or surrounding the first chamber 12, and a third-chamber 16 in fluid communication with the second chamber 14. The first chamber 12 is separated from the second chamber 14 via inner wall 18 (best shown in FIG. 3).

The first chamber 12 and the second chamber 14 are separated from the third chamber 16 via a perforated baffle 20. The perforated baffle 20 includes plural perforations or apertures 52, preferably symetrically spaced (best shown in FIG. 4), about its periphery to facilitate fluid communication between the third chamber 16 and the second chamber 14 and is otherwise solid such that fluid communication between the third chamber 16 and the first chamber 12 is not facilitated. Thus, the housing 10 is divided by the perforated baffle 20 such that the first 12 and second 14 chambers are defined at a first end thereof and a third chamber 16 is defined at a second end thereof. First 70 and second 72 end caps seal the cylindrical housing 10.

A main heat exchanger 22, preferably comprising coiled copper tubing, is disposed within the first chamber 12. A heated gas inlet 24 facilitates the introduction of exhaust from engine 26, preferably an internal combustion engine, via exhaust pipe 28. A heated gas outlet 30 provides fluid communication of the engine exhaust from the first chamber 12 to the second chamber 14.

A water inlet 32 receives water from water pump 34 and introduces the water into the main heat exchanger 22. A water outlet 36 receives water from the main heat exchanger 22 and facilitates fluid communication of the water heated thereby to bypass valve 38 from which a portion of the water may be communicated to wand 66 and also from which at least a portion of the water communicated via tubing 40 to water recovery tank 42.

A preheating heat exchanger 44 is disposed within the third chamber 16. The preheating heat exchanger 44 is preferably comprised of coiled tubing 46, preferably copper, and a heater core 48 in fluid communication with and receiving the output of the coiled tubing 46. The coiled tubing 46 is preferably positioned proximate inlet 50 to the third chamber 16, which provides fluid communication from blower 51 to the third chamber 16.

The blower 51 forces hot air from the water recovery tank 42, containing previously heated water, through the inlet 50 into the third chamber 16. The heated air is then communicated through perforations 52 formed in baffle 20 into the second chamber 14 and out through the second chamber outlet port 54.

Water is communicated from water recovery tank 42 via tube 56 to water inlet 58 through which it is communicated to coiled tubing 46 and heater core 48. The water is then communicated via water outlet 60 and tube 62 to pump 34 from which it is pumped via tube 64 to water inlet 32 for the main heat exchanger 22. A portion of the water output by pump 34 may optionally be routed via tube 63 and bypass valve 65 back to the water recovery tank 42 such that the temperature of the water in the water recovery tank 42 is maintained at a desirable level and/or the volume of water provided to the main heat exchanger 22 is maintained at a level corresponding to the volume demanded by the user at the wand. A portion of the water output by the main heat exchanger 22 may optionally be routed via bypass valve 38 and tube 40 back to the water recovery tank 42 such that the temperature of the water in the water recovery tank 42 is maintained at a desirable level and/or the volume of water provided by the main heat exchanger 22 is maintained at a level corresponding to the volume demanded by the user at the wand.

Makeup water and water vacuumed from the carpet via the wand 66 is communicated via tube 68 to the tank 42. Makeup water is new water added to the system to replace that lost during the cleaning process. Water vacuumed from the carpet is filtered and reused in the cleaning process.

Having thus described the structure of the heater for carpet cleaning systems of the present invention, it may be beneficial to describe the operation thereof. The tank 42 is filled with water via tube 68 to a desired level, leaving an air space above the surface of the water such that a vacuum may be formed by the blower 51 above the water in the water recovery tank 42. Engine 26 drives blower 51 forming a vacuum in tank 42 such that water may be recovered or vacuumed from the carpet via wand 66 and tube 68. The tube 68 is typically connected to the wand 66 such that only a single device or wand 66 needs to be manipulated by the user in order to effect the application and removal of water from the carpet during the cleaning process.

The engine 26 likewise drives pump 34 which receives water from the water recovery tank 42 via the preheating heat exchanger 44 and supplies water to the main heat exchanger 22. Water is communicated from the water recovery tank 42 via tube 56 to the coiled tubing 46 of the preheating heat exchanger 44 and then to the heater core 48 thereof. Water passing through the coiled tube 46 and the heater core 48 is heated to a temperature of approximately 125° F. by hot air taken from water tank 42 and blown into the third chamber 16 through heated gas inlet 50 by blower 51.

As operation of the heater of the present invention continues, the water tank 42 becomes filled with heated water, thereby heating the air contained in the water tank which is then blown into the third chamber 16. The water within the water recovery tank 42 is heated because it comprises hot water vacuumed from the carpet during the cleaning process, hot water output by the main heat exchanger 22 and routed through bypass valve 38 and tube 40 directly back to the water recovery tank 42, and hot water pumped by the pump 34 from the preheating heat exchanger 44 and routed via tube 63 and bypass valve 65 directly back to the water recovery tank 42.

Water from the recovery water tank 42 is heated by the coiled tubing 46 and heater core 48 of the preheating heat exchanger 42 disposed within the third chamber 16. The water then travels through the outlet 60 and tube 62 to the pump 34 from which it is pumped via tube 64 to the inlet 32 of the main heat exchanger 22. A portion of the water output by pump 34 may optionally be routed via tubing 63 and bypass valve 65 directly back to the water recovery tank 42. This may be accomplished in order to either maintain the temperature of the water contained within the water recovery tank 42 at a desired level or to adjust the flow of the hot water output by the pump 34 in order to correspond to the demand for water at the wand.

Exhaust gas from the engine 26, preferably at a temperature of approximately 1000° F., is communicated via exhaust pipe 28 to the heated gas inlet 24 and heats the water traveling through the copper coils of the main heat exchanger 22, preferably to a temperature of approximately 210° F. Routing of the exhaust gas from the motor 26 through the first 12 and second 14 chambers provides a muffling or silencing effect, thereby reducing the amount of noise produced by the motor 26.

The heated water passes through outlet 36. When the trigger of the wand 66 is depressed a portion of the water from the main heat exchanger 22 will flow to the wand to effect cleaning of a carpet. At least a portion of the heated water from the main heat exchanger 22 is optionally diverted by the bypass 38 through tubing 40 to the water tank. This is accomplished in order to maintain the temperature of the water contained within the water recovery tank at a desired level and/or to insure that the water output by the main heat exchanger 22 corresponds to that demanded at the wand.

The blower exhaust from the third chamber 16 enters the second chamber 14 via perforations 52 formed in baffle 20, thus heating the second chamber to a temperature of approximately 200° F. and creating a thermal barrier between the first chamber 12 containing the main heat exchanger 22 and the ambient environment. This dramatically reduces heat loss from the main heat exchanger 22 contained within the first chamber 12 and thereby enhances the efficiency of the heat exchange process. That is, the main heat exchanger 22 is not subject to the same cooling from its ambient environment as would occur in the absence of the heated second chamber 14. Routing of the exhaust from the blower 34 through the third and second chambers provides a muffling or silencing effect upon the exhaust gases, thus reducing the amount of noise produced by the blower.

Thus, the heater for carpet cleaning of the present invention provides a ten to fifteen percent increase in heating efficiency, is compact, and consequently provides substantial cost savings in both fabrication and operation thereof. Furthermore, by communicating both the engine 26 exhaust into the first chamber 12 and the blower 51 exhaust into the third chamber 16, the noise produced by a carpet cleaning system according to the present invention is substantially reduced. The first chamber 12 containing the main heat exchanger and the second chamber 14 cooperate to act as a muffler for the engine 26 while the third chamber 16 containing the preheating heat exchanger 44 and the second chamber 14 cooperate to act as a muffler for the blower 51. Thus, operational efficiency is increased and undesirable noise is reduced.

It is understood that the exemplary heater for a carpet cleaner described herein and shown in the drawings represents only a presently preferred embodiment of the invention. Indeed, various modifications and additions may be made to such embodiment without departing from the spirit and scope of the invention. For example, the housing need not be generally cylindrical in shape, but rather may be of various other configurations. Also, various types and configurations of heat exchangers may be disposed within the first and third chambers. Indeed, various sources of heat may be utilized to provide hot fluids to the heat exchangers within first and third chambers. Thus, these and other modifications and additions may be obvious to those skilled in the art and may be implemented to adapt the present invention for use in a variety of different applications.

What is claimed is:

1. A water heater for a carpet cleaning system, said water heater comprising:

a first chamber;

b) a main heat exchanger disposed within said first chamber, said main heat exchanger utilizing heat from a first source to heat water to be used in the carpet cleaning process;

c) a second chamber substantially surrounding said first chamber, said second chamber being heated from a second source to provide a thermal barrier between said first chamber and the ambient environment; and d) wherein use of the thermal barrier reduces undesirable heat loss from the main first chamber to the ambient environment and thus increases the efficiency of the water heater.

2. The water heater as recited in claim 1 wherein the first source provides heat at a higher temperature than the second source.

3. The water heater as recited in claim 1 wherein the first source provides heat at a temperature of approximately 1000° F. and the second source provides heat at a temperature of approximately 200° F.

4. The water heater as recited in claim 1 wherein:

a) the first source comprises the exhaust from an engine; and b) the second source comprises the output of a blower which draws air from a water tank containing heated water.

5. The water heater as recited in claim 4 wherein said engine drives said blower.

6. The water heater as recited in claim 1 further comprising:

a) a third chamber in fluid communication with said second chamber, said third chamber being heated from said second source and providing heat from said second source to said second chamber; and b) a preheating heat exchanger disposed within said third chamber and in fluid communication with said main heat exchanger such that water flows through said preheating heat exchanger and is heated to a first temperature and then flows through said main heat exchanger and is further heated to a second temperature.

7. The water heater as recited in claim 6 wherein the first temperature is approximately 125° F. and the second temperature is approximately 210° F.

8. The water heater as recited in claim 6 wherein said first, second, and third chambers are disposed within a common housing, said first and second chambers being isolated from said third chamber by a perforated baffle such that heated gas flows from said third chamber to said second chamber, but not from said third chamber to said first chamber.

9. The water heater as recited in claim 6 wherein said preheating heat exchanger comprises:

a) coiled tubing through which the water to be heated flows; and b) a heater core receiving the water from the coiled tubing.

10. The water heater as recited in claim 6 further comprising a bypass for communicating at least a portion of the water heated by said main heat exchanger back to said preheating heat exchanger.

11. A carpet cleaning system for supplying heated water to a wand and for collecting the water dispensed by the wand after it has effected cleaning of a carpet, the carpet cleaning system comprising:

a) an engine, said engine providing an engine exhaust;

b) a blower driven by said engine, said blower providing a blower exhaust;

c) a water tank for receiving the water after is has effected cleaning of the carpet, the blower forming a partial vacuum within the water tank to cause the water to be drawn thereinto;

d) a pump driven by said engine, said pump supplying water to said wand;

e) a preheating heat exchanger receiving water from said tank and utilizing the blower exhaust to heat the water to a first temperature, said preheating heat exchanger comprising:

i) a coil of tubing in fluid communication with said tank;

ii) a heater core in fluid communication with said coil of tubing;

f) a main heat exchanger in fluid communication with said preheating heat exchanger and utilizing the engine exhaust to further heat the water to a second temperature;

g) said main heat exchanger being disposed within a first chamber, a second chamber substantially surrounding said first chamber, said preheating heat exchanger being disposed within a third chamber, said third chamber communicating blower exhaust to said second chamber to provide a thermal barrier between said first chamber and the ambient environment; and h) wherein use of the thermal barrier reduces undesirable heat loss from the first chamber to the ambient environment and thus increases the efficiency of the water heater.

12. A heat exchanger assembly for a carpet cleaning system, said heat exchanger comprising:

a) a cylindrical housing comprising:

i) a first chamber;

ii) a second chamber substantially surrounding said first chamber;

iii) a third chamber in fluid communication with said second chamber, said third chamber being separated from said first and second chamber by a partition;

b) a preheating heat exchanger disposed within said third chamber for receiving and heating water;

c) a main heat exchanger disposed within said first chamber for receiving water from said preheating heat exchanger and further heating the water;

d) said third chamber having an intake port for receiving a first heated fluid from a first source, said first heated fluid heating water via said preheating heat exchanger and then being communicated to said second chamber to provide a thermal barrier between said first chamber and the ambient environment; and e) said first chamber having an intake port for receiving a second heated fluid from a second source, said second heated fluid having a higher temperature than said first heated fluid, said second heated fluid further heating the water via the main heat exchanger.

13. A method for heating water for a carpet cleaning system, the method comprising the steps of:

a) preheating the water with a first heat exchanger utilizing the exhaust from a blower used to form a partial vacuum in a water tank;

b) further heating the water with a second heat exchanger utilizing the exhaust from an engine;

c) substantially surrounding the second heat exchanger with the exhaust from the blower to provide a thermal barrier between the first heat exchanger and the ambient environment; and d) wherein surrounding the first heat exchanger with the exhaust from the blower reduces undesirable heat loss from the first heat exchanger to the ambient environment and increases the efficiency of the heater.

14. The method as recited in claim 13 wherein:

a) the step of preheating the water comprises preheating the water to a temperature of approximately 125° F.; and b) the step of further heating the water comprises further heating the water to a temperature of approximately 210° F.

15. The method as recited in claim 13 further comprising the step of bypassing at least a portion of the water further heated by the second heat exchanger back to the first heat exchanger.

* * * * *